US005995008A

United States Patent [19]

King et al.

[11] Patent Number: 5,995,008

[45] Date of Patent: *Nov. 30, 1999

[54] FIRE DETECTION METHOD AND APPARATUS USING OVERLAPPING SPECTRAL BANDS

[75] Inventors: John D. King, Roseville; Frederick J. Schuler, Lakeville, both of Minn.

[73] Assignee: Detector Electronics Corporation, Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/852,086

[22] Filed: May 7, 1997

[51] Int. Cl.[6] ..... G08B 17/12

[52] U.S. Cl. ..... 340/578; 250/339.15

[58] Field of Search ..... 340/578, 577; 250/339.15, 340

[56] References Cited

U.S. PATENT DOCUMENTS

| | | | |
|---|---|---|---|
| 3,824,391 | 7/1974 | Noltingk et al. | 340/578 |
| 3,859,520 | 1/1975 | Hertzberg et al. | 250/226 |
| 3,940,753 | 2/1976 | Müller | 340/578 X |
| 4,101,767 | 7/1978 | Lennington et al. | 250/339.04 |
| 4,160,163 | 7/1979 | Nakauchi | 250/339.15 |
| 4,206,454 | 6/1980 | Schapira et al. | 340/578 |
| 4,220,857 | 9/1980 | Bright | 250/339.15 |
| 4,280,058 | 7/1981 | Tar | 340/578 X |
| 4,296,324 | 10/1981 | Kern et al. | 250/339.15 |
| 4,357,534 | 11/1982 | Ball | 250/339.15 |
| 4,414,542 | 11/1983 | Farquhar et al. | 340/578 |
| 4,421,984 | 12/1983 | Farquhar et al. | 250/339.04 |
| 4,463,260 | 7/1984 | Ikeda | 250/339.15 |
| 4,533,834 | 8/1985 | McCormack | 340/578 X |
| 4,553,031 | 11/1985 | Cholin et al. | 250/339.15 |
| 4,639,598 | 1/1987 | Kern et al. | 340/578 X |
| 4,691,196 | 9/1987 | Kern et al. | 340/578 |
| 4,742,236 | 5/1988 | Kawakami et al. | 340/578 X |
| 4,785,292 | 11/1988 | Kern et al. | 340/578 |
| 4,866,420 | 9/1989 | Meyer, Jr. | 340/578 |
| 5,373,159 | 12/1994 | Goldenberg et al. | 250/339.15 |
| 5,594,421 | 1/1997 | Thuillard | 340/578 |
| 5,804,825 | 9/1998 | Schuler | 250/339.15 |

FOREIGN PATENT DOCUMENTS

| | | |
|---|---|---|
| 1 550 334 | 8/1979 | United Kingdom . |
| WO 97/32288 | 9/1997 | WIPO . |

*Primary Examiner*—Jeffery A. Hofsass
*Assistant Examiner*—Sihong Huang
*Attorney, Agent, or Firm*—Merchant & Gould P.C.

[57] ABSTRACT

An optical fire detector employs two or more sensors operating a different spectral bands. The spectral bands are selected to have approximately coincident cut-off wavelengths in order to make the detector's ability to positively identify a fire more uniform over its field of view. The use of three overlapping spectral bands provides the detector with enhanced detection capabilities for large, hot fires that behave like black body radiators.

69 Claims, 12 Drawing Sheets fire $_i$ fnarrow$_{i.0}$ fwide$_{i.0}$ fwide2$_{i.0}$ bb $_i$ bb1 $_i$

FIRE DETECTION METHOD AND APPARATUS USING OVERLAPPING SPECTRAL BANDS

BACKGROUND

The present invention is directed generally to a method and apparatus for detecting fires, and particularly to a method and apparatus for optically detecting fires using a combination of two or more wavelengths.

It is important that an optical fire detector is able to detect the presence of various types of flame in as reliable a manner as possible. This requires that the flame detector can discriminate between flames and other sources of infrared radiation. Commonly, optical flame detection is carried out in the infrared portion of the spectrum at around 4.5 $\mu$m, a $CO_2$ emission peak.

Simple flame detectors employ a single sensor, and a warning is provided whenever the signal sensed by the detector exceeds a particular threshold level. This simple approach suffers from false triggering, because it is unable to discriminate between flames and other bright objects, such as incandescent light bulbs, hot industrial processes such as welding, warm hands waved in front of the detector, and even sunlight.

Attempts have been made to overcome this problem by sensing radiation at two or more wavelengths. A comparison of the relative strengths of the signals sensed at each wavelength permits greater discrimination over false sources than when sensing at only a single wavelength.

Despite the implementation of detectors sensitive to radiation at more than one wavelength, optical detection techniques for detecting the presence of flames are still subject to high rates of false alarms, and misdiagnosis of true fires. For example, there is a difficulty in producing true alarms when monitoring fires at a long distance from the detector, say up to approximately 200 feet, when the signal to noise ratio is small. Also, fire detectors suffer from an inconsistency in fire detection characteristics under different fire conditions, for example fire temperature, size, position, fuel, and interfering background radiation. Consequently, there is a need for a fire detector whose ability to detect fires is less dependent on these factors.

SUMMARY OF THE INVENTION

Generally, a particular embodiment of the present invention relates to a method and apparatus for detecting the presence of a fire using a plurality of sensors sensitive to radiation in overlapping spectral bands. Cut-off wavelengths of at least two of these spectral bands are essentially similar.

In another embodiment of the invention, the cut-off wavelengths of the overlapping bands vary in essentially similar manners when the angle of incidence on the detectors is altered.

In another embodiment of the invention, two of the spectral bands have essentially similar short cut-off wavelengths. In another embodiment of the invention, first and second spectral bands have essentially similar long cut-off wavelengths.

The above summary of the present invention is not intended to describe each illustrated embodiment, nor every implementation of the present invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
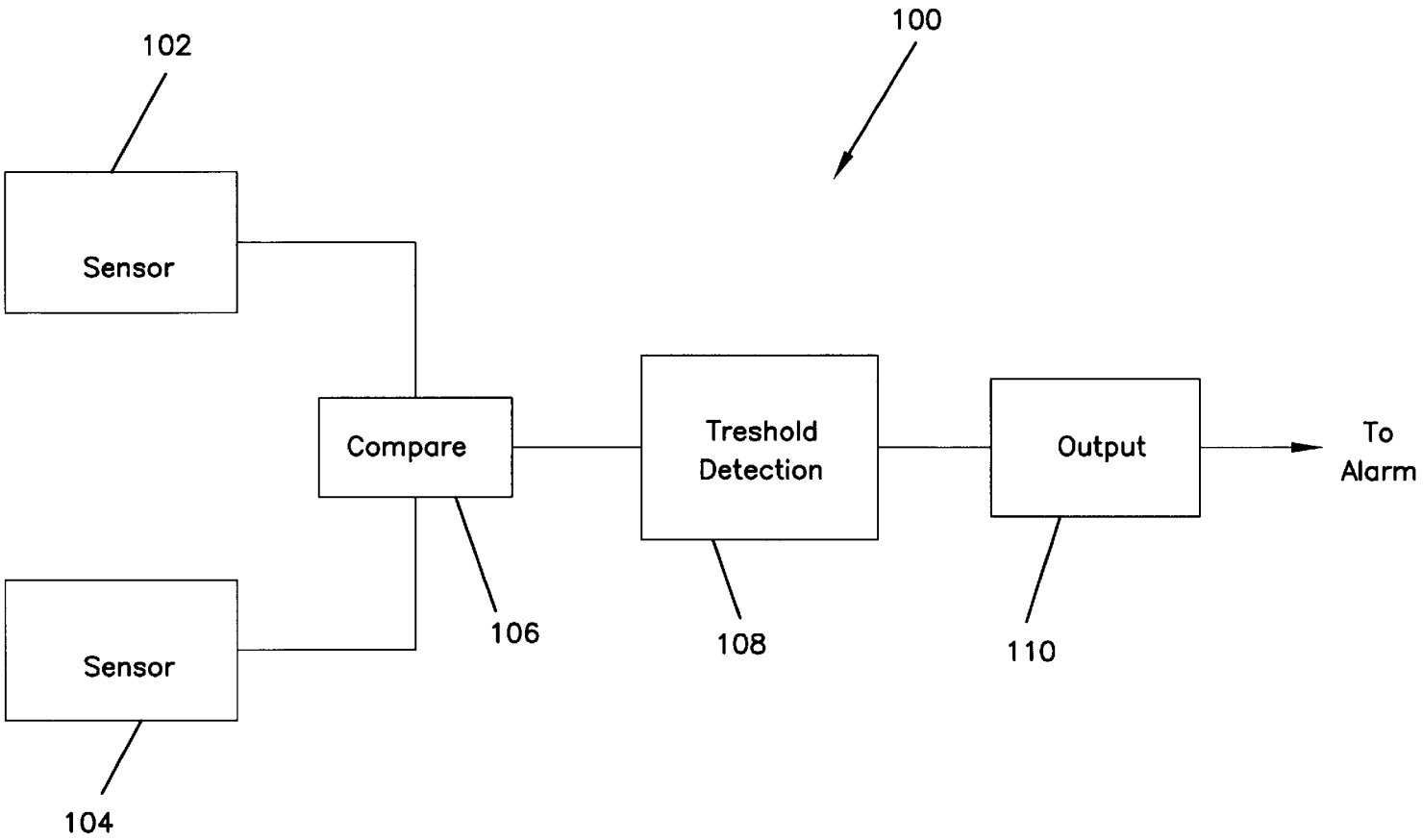
FIG. 1 illustrates a block diagram schematic of an optical detector apparatus for detecting the presence of fire.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is applicable to optical fire detectors. The present invention is believed to be particularly suited to detecting fires where low false alarms rates are required, where the response of the detector over the complete field of view is required to be uniform, and where the distance and size of the fire may vary over a wide range. While the invention is not so limited, an appreciation of the various aspects of the invention will be better understood by reference to the examples provided for such a detector.

One of the problems addressed by the present invention is that fire detection techniques have been found to produce inconsistent results for fires occurring at different points in the detector's field of view. This problem arises due to the interference filters employed with the sensors to transmit radiation in the desired spectral bands. The passbands of the interference filters vary with the angle at which the radiation from a fire is incident on the filter. As a result, the amount of radiation sensed is dependent on the angle of incidence, and, in consequence, the detector may not be as effective at detecting a fire when the fire is positioned off-axis from the sensor.

FIG. 1 illustrates a generalized optical fire detection apparatus 100, which has a first sensor 102 and a second sensor 104 sensitive to radiation in different spectral bands. Signals generated by the first and second sensors 102 and 104 are fed into a comparison circuit 106 where they are compared, for example by forming a ratio or a difference. The comparison signal thus formed is then measured against a threshold in the threshold detection circuit 108. If the ratio is determined to have a preselected relationship with the threshold 108, for example if the ratio is larger than the threshold, an output signal is generated at the output 110 to activate an alarm. It will be understood that different approaches for processing the signals produced by the detectors 102 and 104 are possible. Some of these are discussed hereinbelow. Also, it will be appreciated that the signals produced by the sensors 102 and 104 may be processed in a number of types of circuit, for example hardwired analog circuits, or in programmable digital circuits, such as a digital signal processor.

The selection of the spectral characteristics for the sensors is important. The spectral range over which a sensor is sensitive is set primarily by an optical interference bandpass filter. The wavelengths of these filters need to match the wavelengths emitted from the fires and simultaneously avoid strong atmospheric absorption effects. Not only do the emitted wavelengths vary somewhat, depending on the type of fuel and size of fire, but the optical passbands of the interference filters vary with angle of incidence of the incoming radiation. Thus, in devices with a large field of view, the wavelengths of the passband filters are significantly blue-shifted when the fire is located off the optical axis of the sensor.

Figure 2A:
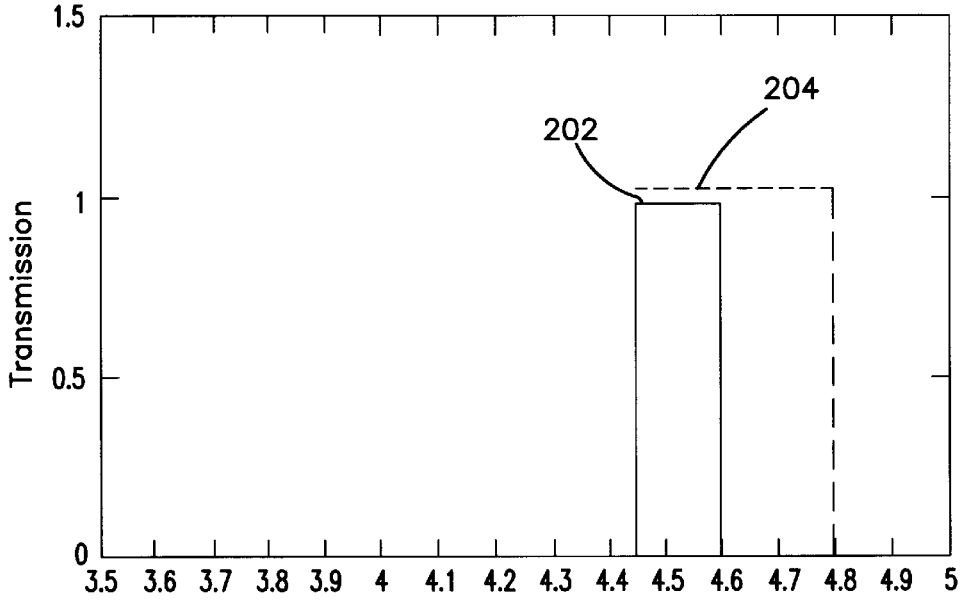
FIGS. 2A–2D illustrate combinations of narrow and wide spectral filters.

FIG. 2A illustrates the transmission characteristics of a first combination of filters. The transmission band 202 of a first filter is centered at approximately 4.5 $\mu$m and has a bandwidth of approximately 0.15 $\mu$m. The transmission band 204 of a second filter 12 has a bandwidth of approximately 0.35 $\mu$m and is centered at approximately 4.7 $\mu$m. Although the first and second bands 202 and 204 are illustrated to have different values of maximum transmission, this is only a device of the figure to clearly illustrate where their respective cut-off wavelengths lie. The maximum transmission values of the first and second transmission bands 202 and 204 may be similar.

It will appreciated that the filter passbands illustrated herein are idealized passbands, useful for theoretical modeling, and that practical transmission spectra may not be as flat as those illustrated. It will further be appreciated that theoretical modeling of the characteristics of systems employing filters may be performed to produce adequate results where idealized filter profiles are assumed.

The transmission spectra 202 and 204 have short cut-off wavelength values of approximately 4.45 $\mu$m, and are approximately coincident. The first transmission spectrum 202 has a long wavelength cut-off at approximately 4.6 $\mu$m and the second spectrum 204 has a long wavelength cut-off at approximately 4.8 $\mu$m. It has been determined that this configuration of filters increases the uniformity of ratio values for fires across the field of view of the detector.

Interference filters, which are typically used to define spectral detection bands in fire detectors, undergo a shift in transmission properties as the angle of incidence of the incoming radiation increases from normal incidence. For example, a standard interference filter can manifest a blue shift of as much as 6% in its passband properties for light incident at 45° from normal. Higher quality filters demonstrate a shift of around 2% for light at 45° incidence. This shift to shorter wavelengths can have a significant impact on the signal magnitude detected by the detector, particularly when important spectral features, such as the 4.4 $\mu$m peak, lie close to the filter cut-off wavelength.

An advantage provided by the first filter combination, illustrated in FIG. 2A, may be understood by comparing the behavior of the combination with different combinations of filter. FIGS. 3–5 illustrate the results of an analysis of the behavior of different combinations of filters where the fire occurs at different points within the field of view.

Figure 3A:
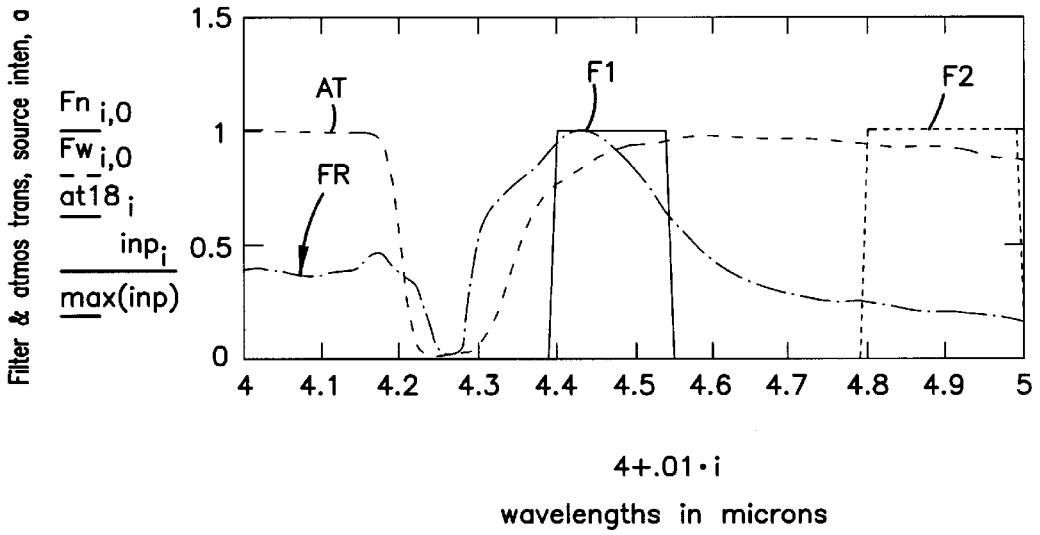
FIG. 3A illustrates a combination of filters.

FIG. 3A illustrates the passband, F1, of a first filter centered about the $CO_2$ emission feature. F2 is the passband of a second filter covering a higher wavelength range from 4.8 $\mu$m to 5.0 $\mu$m. In this case, there is no overlap between the two passbands. The dashed line, marked AT, corresponds to optical transmission characteristics of the atmosphere, and shows that there is an absorption maximum at approximately 4.25 $\mu$m. The dash-dotted line, marked FR, is a typical emission spectrum from a gasoline fire. This combination of F1 and F2 is typical of some conventional fire detectors.

Figure 3B:
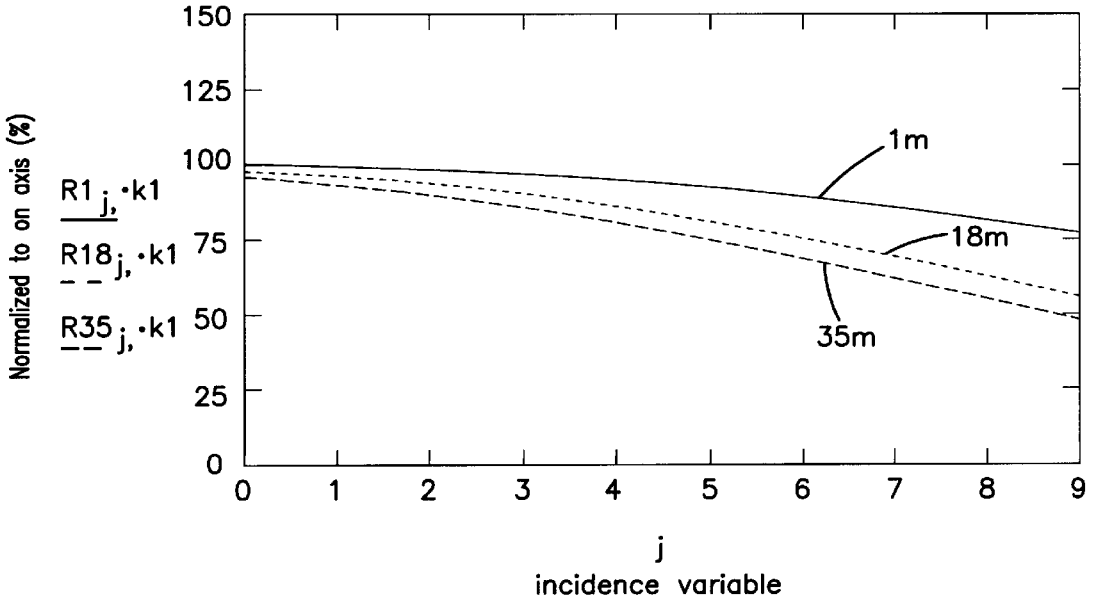
FIG. 3B illustrates detector characteristics obtained using the combination of filters illustrated in FIG. 3A.

FIG. 3B illustrates the dependence of the signal ratio from a detector using the filter combination of FIG. 3A as a function of angle of incidence on the detector. This dependence is plotted for three different separations between the fire and the detector, namely 1 m, 18 m, and 35 m. The curves are normalized to the ratio for a fire at normal incidence for each of the three distances. A value of 9 on the x-axis corresponds to an angle of incidence at which the location of the passband of each filter has moved by 2%. These curves show that the ratios of signals detected by F1 and F2 change considerably for fires located off normal incidence. For fires at a distance of 35 meters, for example, the ratio falls from approximately 100% to approximately 50%. Thus, the presence of a fire is determined less reliably as the source of the fire moves away from the optical axis.

Figure 4A:
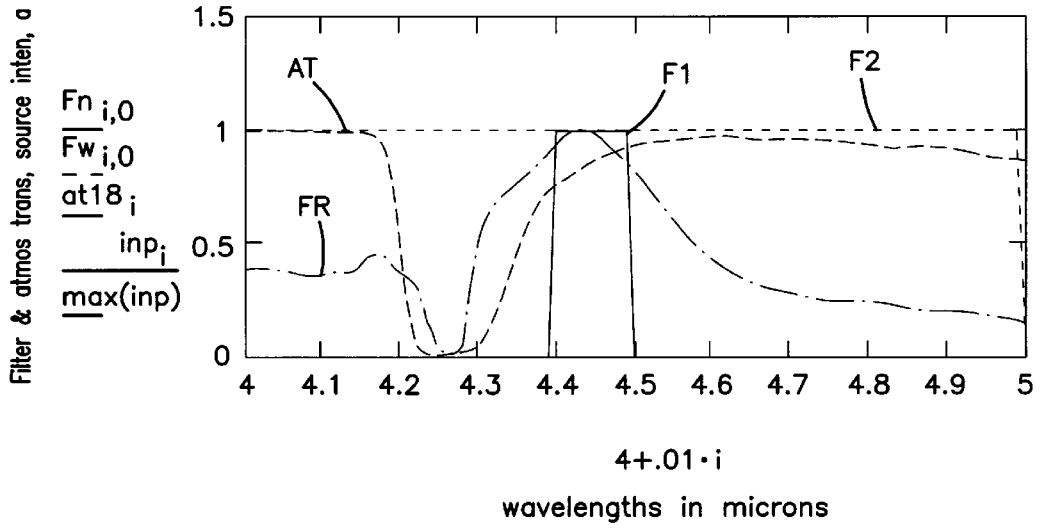
FIG. 4A illustrates another combination of filters.
Figure 4B:
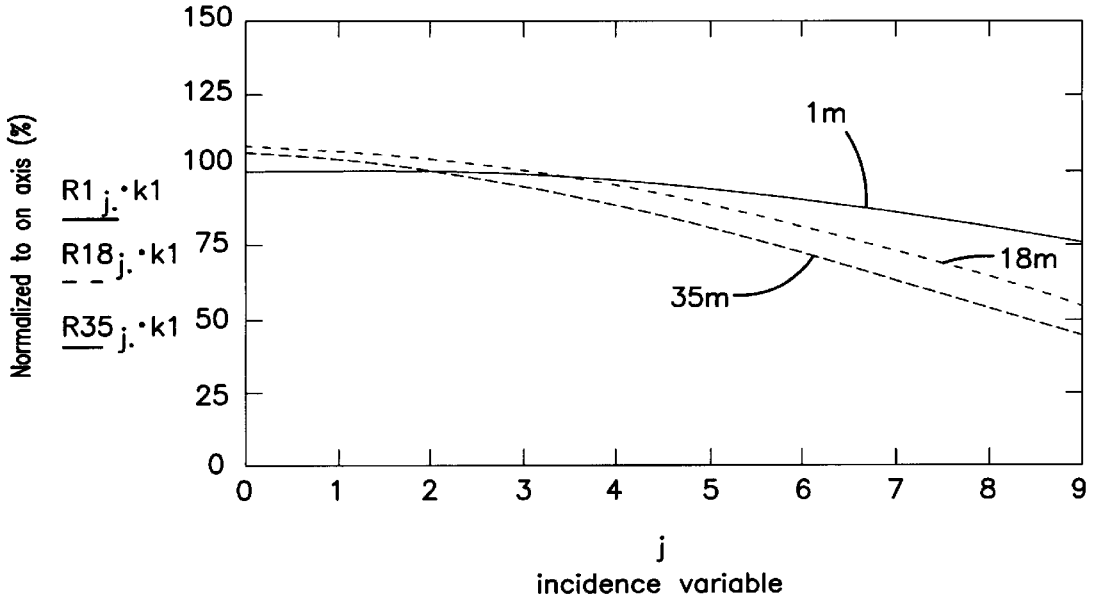
FIG. 4B illustrates detector characteristics obtained using the combination of filters illustrated in FIG. 4A.

FIG. 4A illustrates the same spectra as in FIG. 3A except that filter F2 has a transmission passband extending between 4 $\mu$m and 5 $\mu$m, and completely encompasses the passband of filter F1. Additionally, the passband of filter F1 is slightly narrower, extending from approximately 4.4 $\mu$m to 4.5 $\mu$m. The fire spectrum, FR, and atmosphere spectrum, AT, are the same. FIG. 4B again shows the dependence of the ratios of signals obtained between F1 and F2 as a function of angle of incidence. Again, the ratios decrease when the passbands of the filters are blue-shifted by 2%. At one meter, the ratio falls to approximately 75% and for a fire at 35 meters, the ratio falls off to approximately 45%.

Figure 5A:
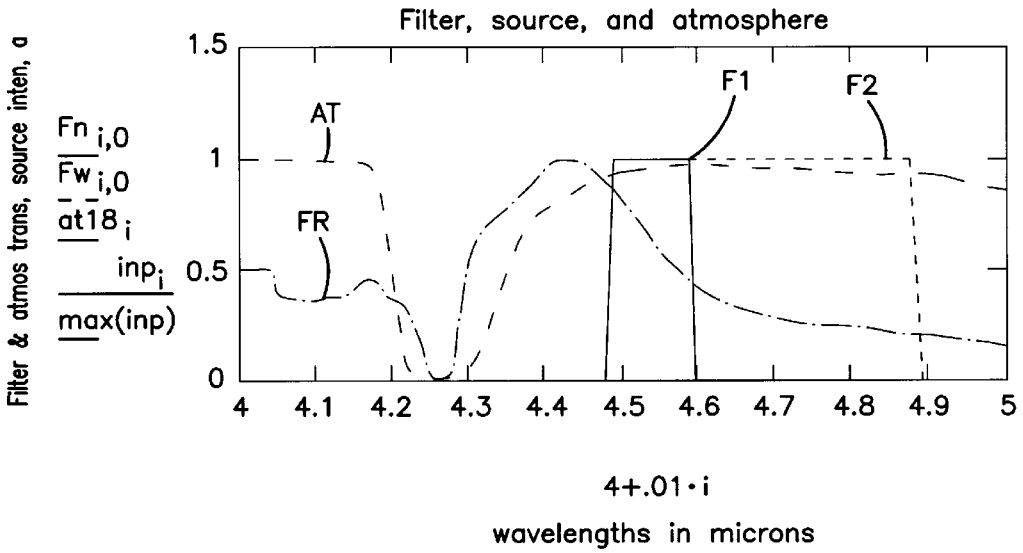
FIG. 5A illustrates a different combination of filters.
Figure 5B:
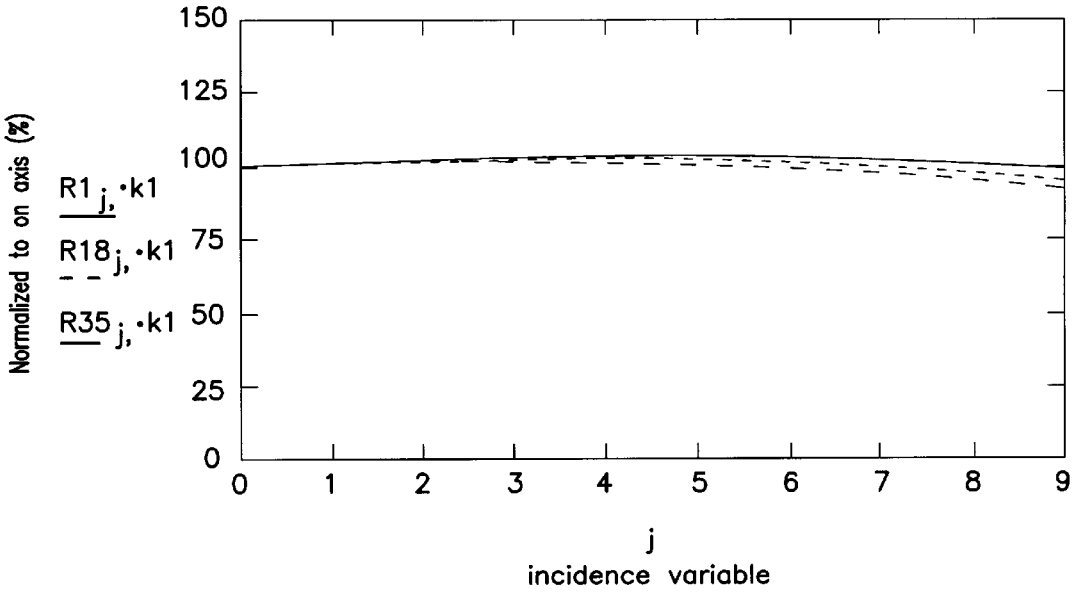
FIG. 5B illustrates detector characteristics obtained using the combination of filters illustrated in FIG. 5A.

FIG. 5A illustrates the case where the filter combination is similar to that illustrated in FIG. 2A. The spectrum of filter F2 has a short wavelength cut-off just below 4.5 $\mu$m, and is coincident with the short wavelength cut-off of filter F1. As can be seen in FIG. 5B, the ratios for fires at 1, 18 and 35 meters stay relatively constant over the range of incident angles, i.e., to within approximately 10%. Therefore, the detector is less susceptible to variation in detection characteristics where the fire is located away from normal incidence on the detector. This holds where the two filters have an overlapping portion, and where either both of their short cut-off wavelengths or both of their long cut-off wavelengths are essentially similar. The variation in ratio increases over the range of angle of incidence where the cut-off wavelengths are not similar.

The short and long cut-off wavelengths for a filter may be defined to be the wavelengths at which the transmission of that filter is 50% of its maximum transmission value. The full width, half maximum (FWHM) bandwidth of the filter is the separation between its long and the short cut-off wavelengths. The FWHM bandwidth of the narrow filter typically ranges from 0.15 $\mu$m to 0.2 $\mu$m, although it may lie outside of this range. The short cut-off wavelengths of different filters are substantially similar when their separation is less than 50% of the FWHM bandwidth of the narrow filter. Similarly, the long cut-off wavelengths of the filters are substantially similar when the separation between them is less than 50% of the FWHM of the narrow filter. The cut-off wavelengths are more than substantially similar when they are separated by less than 15% of the FWHM bandwidth of the narrow filter, and still more than substantially similar when separated by less than 5% of the FWHM bandwidth of the narrow filter. The cut-off wavelengths may also be taken as being substantially similar when the filters exhibit a change in ratio of less than 35% over the field of view of the detector.

Additionally, the variation in ratio with angle of incidence may change where the cut-off wavelengths vary with the angle of incidence in different ways. The angle-dependence of the ratio may change depending on whether the respective cut-off wavelengths of the two filters change with angle of incidence at the same rate. For example, the angle-dependence of the ratio may be different where the wavelengths of one of the filters change by 6% over the field of view, and the other filter changes by 2%, and where both filters change by 2% over the field of view. The angle-dependence of the wavelengths ($\epsilon\lambda/\delta\theta$) of the filters are substantially the same when their angle-dependencies are matched to within 25% over the field of view of the detector, i.e. the value of ($\delta\lambda/\delta\theta$)for one filter is within 25% of the value of ($\delta\lambda/\delta\theta$) of the other filter. More preferably, the filter values of ($\delta\lambda/\delta\theta$) are within ±15% of each other. Another way of looking at this is that the angle-dependencies are substantially similar when the signal ratios change by less than 35% over the field of view.

Figure 2B:
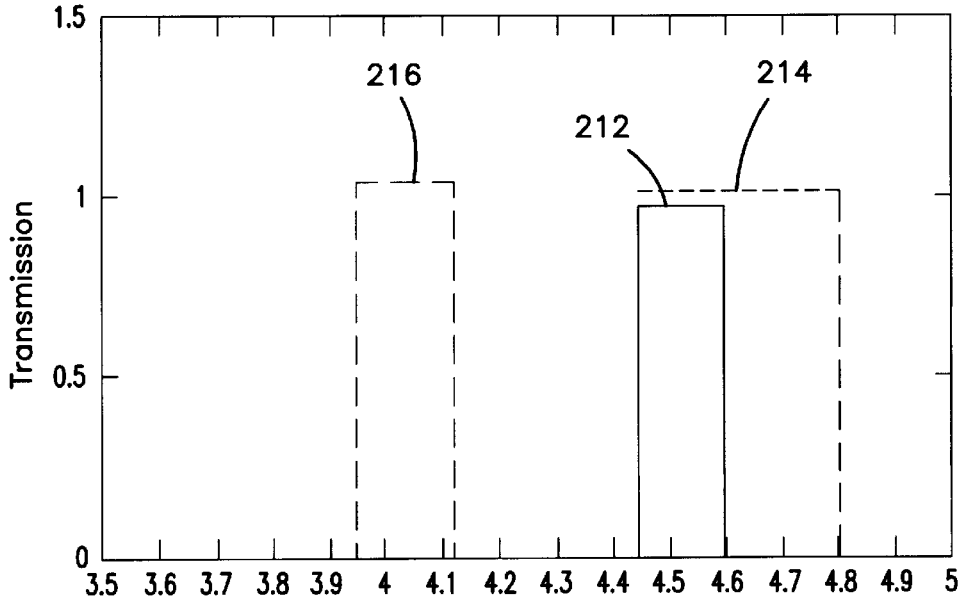

Referring now to FIG. 2B, a third filter 216, lying at shorter wavelengths than a combination of overlapping filters 212 and 214 provides enhanced detection of fires. Cool infrared sources have less energy at short wavelengths, while hot sources have relatively less energy at longer wavelengths. Thus, a combination of three filters such as illustrated in FIG. 2B may be useful in separating the effects of both hot and cold false alarm sources.

Figure 2C:
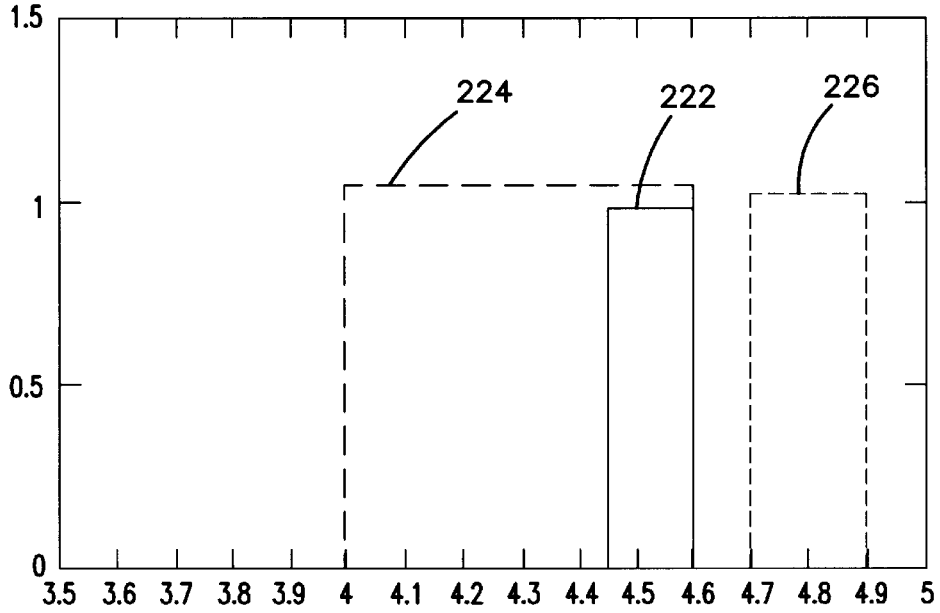

Another combination of three filters is illustrated in FIG. 2C. Here, a first filter 222, having a relatively narrow bandwidth and centered around 4.5 $\mu$m is used in combination with a second filter 224 which overlaps the first filter 222 and is positioned to the short wavelength side of the first filter 222. The long wavelength cut-off of the second filter 224 is essentially the same as the long wavelength cut-off of the first filter 222. A third filter 226, which does not overlap with either of the first two filters 222 and 224, is positioned at a longer wavelength. This combination of filters generally reflects a mirror image of the combination illustrated in FIG. 2B, and is also effective at reducing the number of false alarms.

Figure 2D:
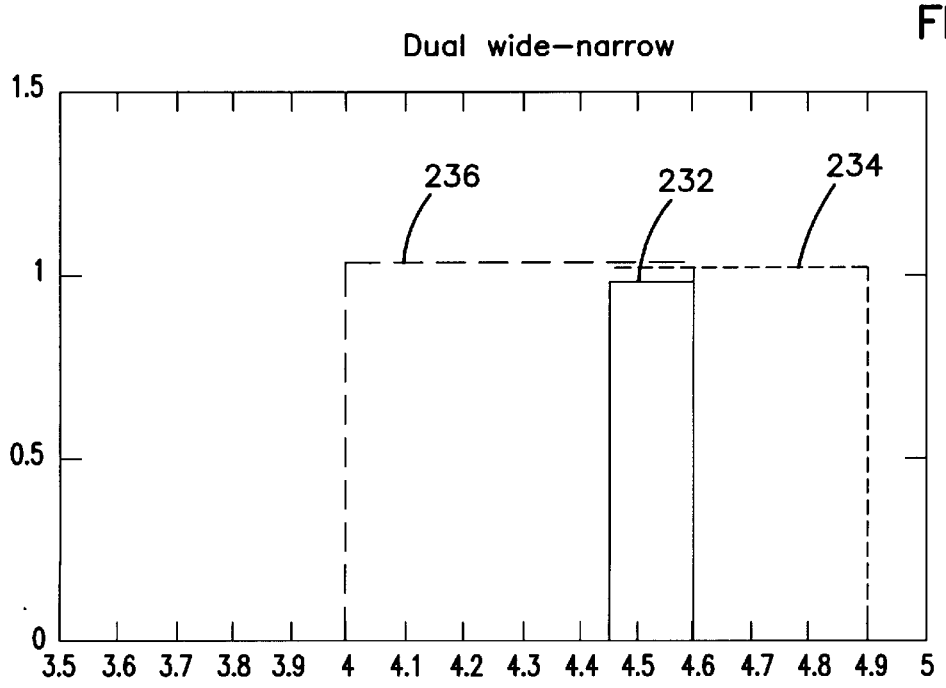

A fourth combination of filters is illustrated in FIG. 2D, in which a narrow filter 232 is positioned close to the $CO_2$ emission feature at 4.5 $\mu$m. The bandwidth of the first filter 232 typically ranges from approximately 0.1 to 0.2 $\mu$m. The second filter 234 overlaps the first filter 232 from the long wavelength side, so that their short cut-off wavelengths are essentially coincident. A third filter 236 overlaps the first filter 232 from the short wavelength side so that the long cut-off wavelengths of the narrow filter 232 and the third filter 236 are essentially coincident. A filter set of this type has advantages in improving the discrimination between large, dirty fires and background black body sources. Dirty fires are more difficult to detect than clean fires because radiation from hot soot produces an emission spectrum similar to that of a radiating hot black body. Additionally, the 4.5 $\mu$m feature is less prominent than in the cleaner fires.

In the following description, the first filter 232 is referred to as the narrow filter, the second filter 234 is referred to as the long-wide filter, and the third filter 236 is referred to as the short-wide filter.

Figure 7A:
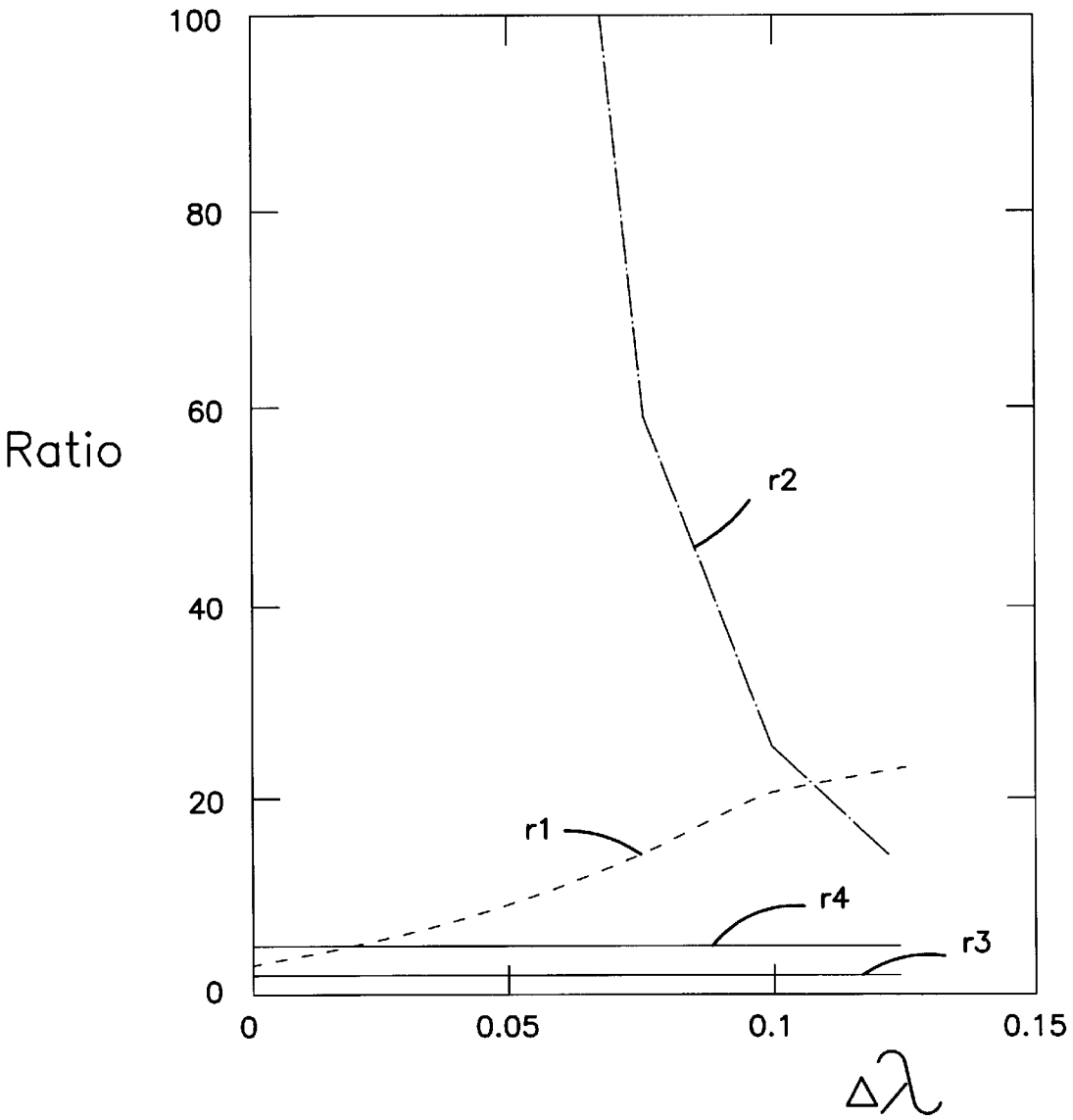
FIGS. 7A–7C illustrate detector characteristics obtained for the filters and emission spectra of FIGS. 6A and 6B.
Figure 7B:
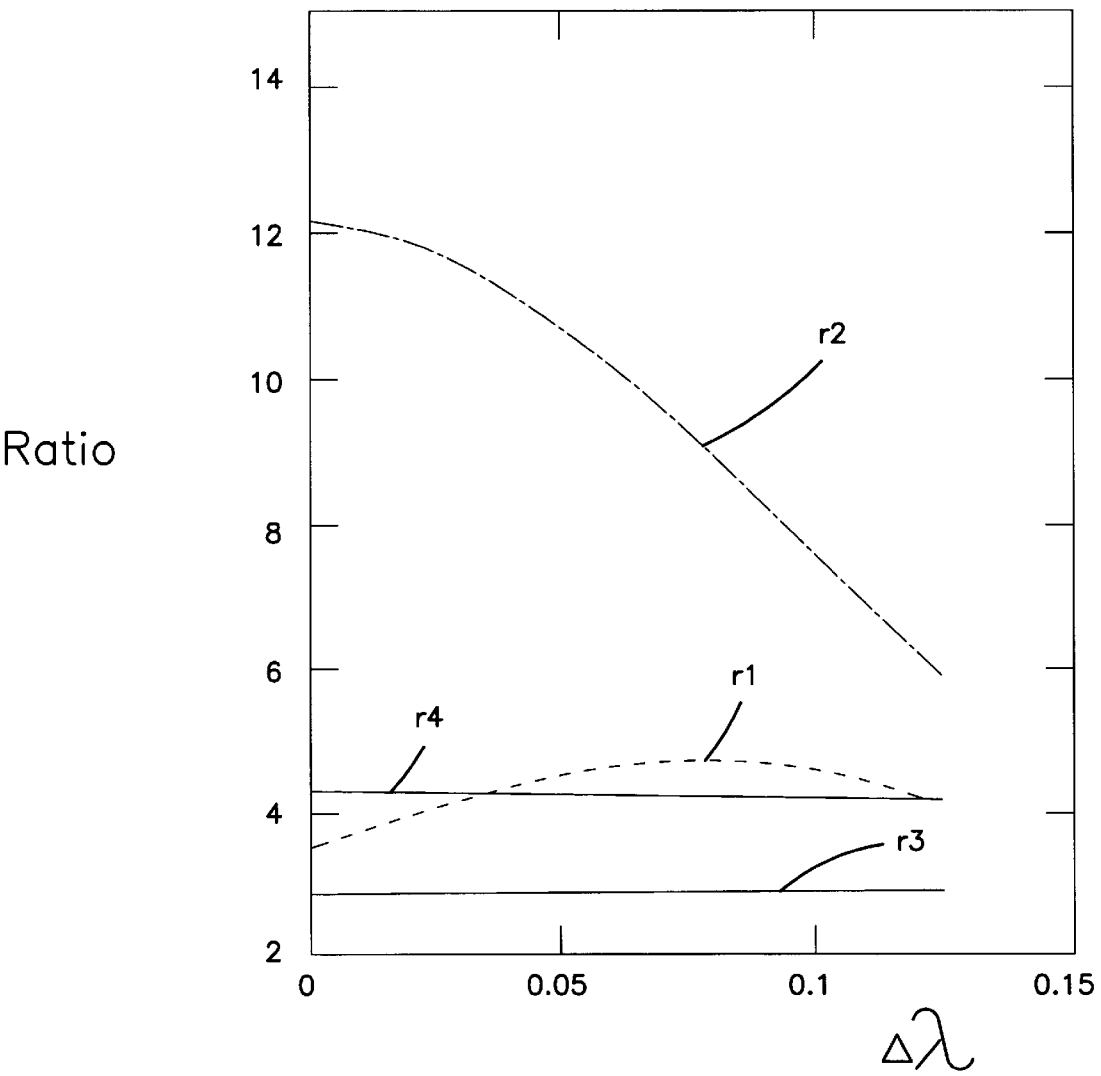
Figure 7C:
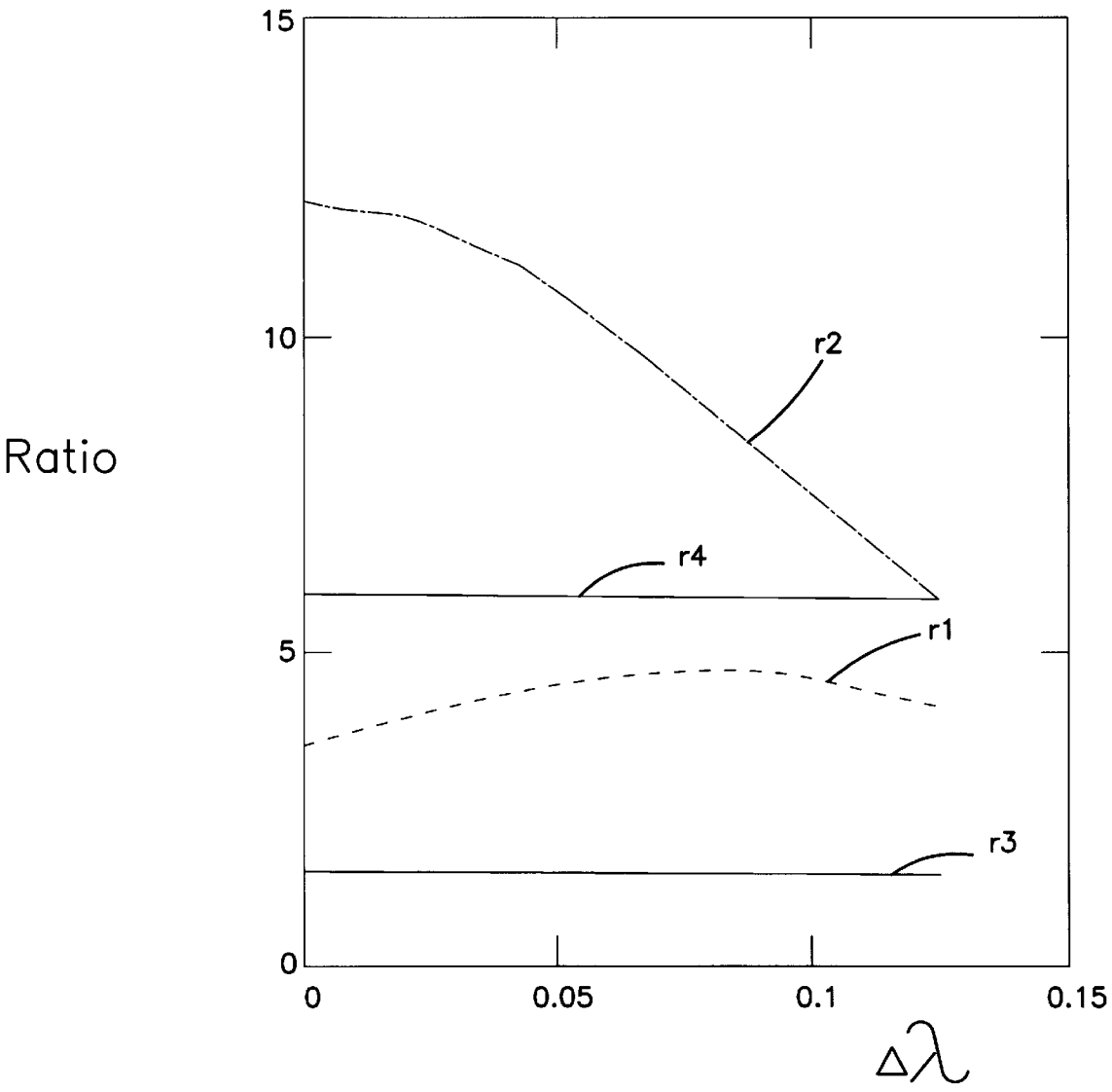

FIGS. 7A–7C illustrate several signal ratios as a function of angle of incidence on the detector, illustrating the ability of the filter combination shown in FIG. 2D to distinguish fire signals in the presence of hot black body backgrounds.

Figure 6A:
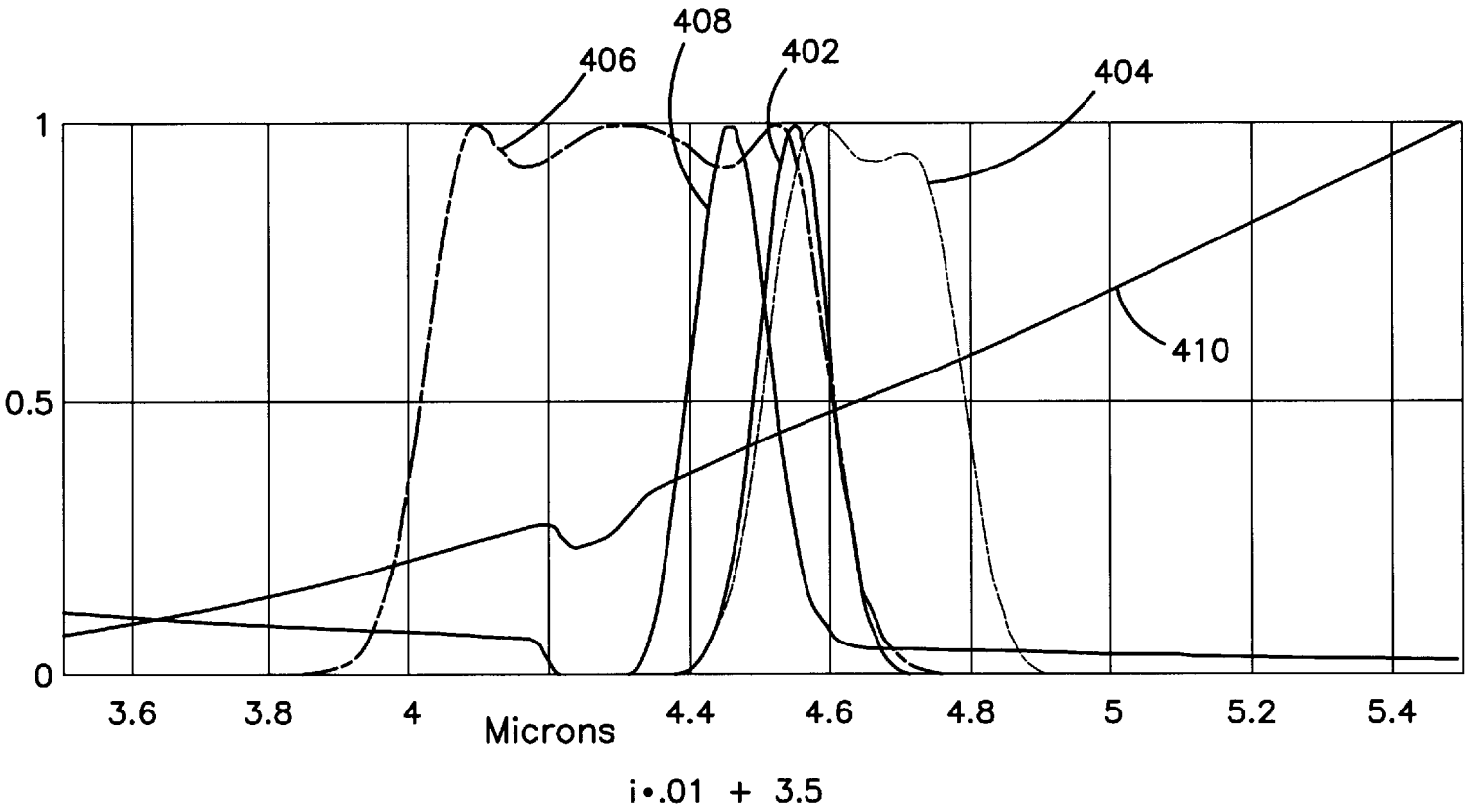
FIGS. 6A and 6B illustrate filter combinations and emission spectra for different types of fire and background radiation sources.

The conditions assumed in generating the results shown in FIG. 7A are illustrated in FIG. 6A. The narrow filter 402 is centered at approximately 4.55 $\mu$m. The long-wide filter 404 is positioned to the long wavelength side of the narrow filter 402. The short cutoff wavelength of the long-wide filter 404 is very close to the close wavelength cutoff of the narrow filter 402. The short-wide filter 406 lies to the short wavelength side of the narrow filter 402, and its long wavelength cutoff is approximately coincident with the long wavelength cutoff of the narrow filter 402. The relative emission spectrum of a small, clean fire 408 has a prominent peak close to 4.5 $\mu$m, and has a small amount of energy at shorter wavelengths. The relative emission spectrum 410 from a black body having a temperature of 310 K is also shown, normalized over the wavelength range of interest. The fire spectrum 408 and the background black body spectrum 410 both show some absorption at approximately 4.25 $\mu$m resulting from absorption by $CO_2$ in the atmosphere. The black body is assumed to be at a distance of 2 meters, and the fire at a distance of 65 meters. The center of the narrow filter transmission band 402 is positioned to the long wavelength side of the prominent emission peak in the fire spectrum 408 in order to avoid complications arising from blue-shifting into the $CO_2$ absorption band at 4.25 $\mu$m under off-axis conditions.

The temperature of the black body background was used as a variable in the analysis. The black body spectrum 410 could be altered to approximate the operation of a detector under different black body emission conditions. For example, a black body signal at approximately 310 K approximates the background detected from emission by walls of a room at room temperature. A black body signal at 5800 K approximates the operation of a fire detector under conditions of bright sunlight.

Several ratios are plotted in FIG. 7A against shift in cut-off wavelength, $\Delta\lambda$, in microns resulting from increasing the angle of incidence on the filters. It is important to note that the ratios illustrated in FIGS. 7A–7C are defined differently from the ratios illustrated in FIGS. 3–5. Here, the denominator of the ratio is the wide filter signal minus the narrow filter signal. Thus, the first ratio r1 represents the ratio of the signal from the narrow filter 402 divided by the signal from the short-wide filter 406 minus the signal from the narrow filter 402. The ratio r2 is the ratio of the signal from the narrow filter 402 divided by the signal from the long-wide filter 404 minus the signal from the narrow filter 402. Both ratios r1 and r2 result from the signal generated by the fire. In contrast, the ratios r3 and r4 represent signals generated by the black body radiation. Ratio r3 is the ratio of the black body signal detected by the narrow filter 402 divided by the black body signal detected by the short-wide filter 406 minus the black body signal divided by the narrow filter 402. Additionally, the fourth ratio r4 is produced by the black body signal detected through the narrow filter 402 divided by the black body signal detected through the long-wide filter 404 minus the black body signal detected by the narrow filter 402. In summary, the definitions of the ratios r1–r4 are shown in the following table.

TABLE 1

Definitions of Ratios r1–r4

| ratio | numerator | denominator |
|---|---|---|
| r1 (fire) | narrow | short-wide - narrow |
| r2 (fire) | narrow | long-wide - narrow |
| r3 (B.B. background) | narrow | short-wide - narrow |
| r4 (B.B. background) | narrow | long-wide - narrow |

Under this definition of ratios, the ratio r2 decreases as the angle of incidence on the detector increases. On the other hand, the ratio r1 increases with increasing angle of incidence. However, r2 always stays significantly above the background ratio r4. Therefore, where the fire is small and clean, and the emission feature at 4.5 $\mu$m is prominent, there is little difficulty in determining the presence of a fire for all angles of incidence resulting in a filter blue-shift of up to approximately 0.1 $\mu$m.

Figure 6B:
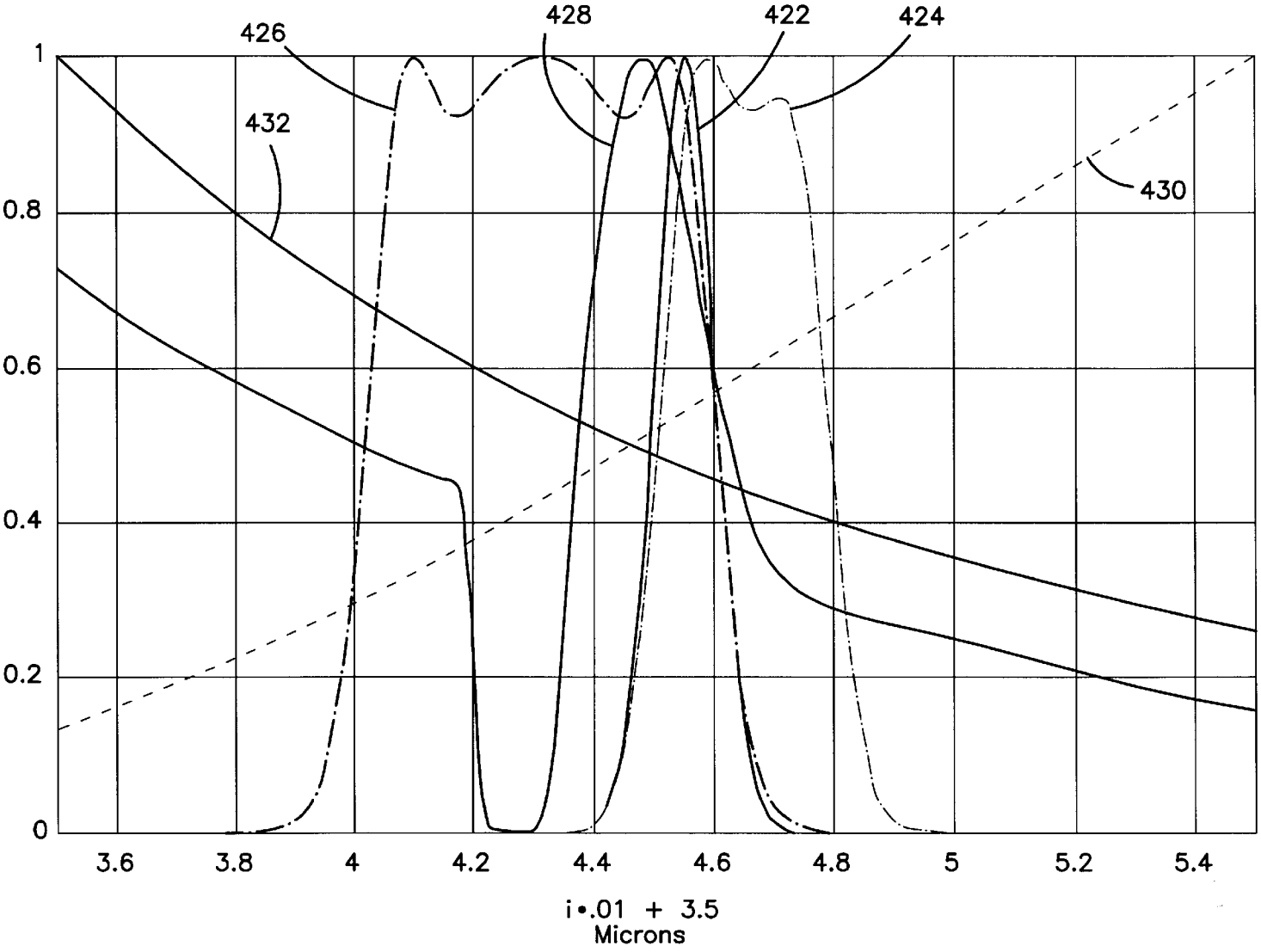

FIG. 6B illustrates the transmission spectra of the three filters 422, 424 and 426, a fire spectrum 428 generated by a dirty fire, and two normalized black body spectra 430 and 432. The narrow filter 422 is positioned close to 4.55 $\mu$m. The long-wide filter 424 is positioned to the long wavelength side of the narrow filter 422 and their respective short cutoff wavelengths are approximately coincidental. The short-wide filter 426 is positioned to the short wavelength side of the narrow filter 422, and their respective long cutoff wavelengths are essentially coincidental. The emission spectrum 428 from the large, dirty fire 428 looks more like that of a hot black body radiator than the emission spectrum 408 from the clean fire, but still includes a peak at approximately 4.4 $\mu$m. A normalized black body radiator background spectrum 430 is shown for a black body at a temperature of 310 K. A second normalized black body radiator background spectrum 432 is shown for a black body at 5800 K.

FIGS. 7B and 7C illustrate the behavior of the ratios r1 through r4 as a function of shift in cut-off wavelength, $\Delta\lambda$, for the two different black body background spectra 430 and 432 respectively. In FIG. 7B, the black body background is assumed to be that of spectrum 430, i.e. a black body at a temperature of approximately 310 K. Here the ratio r2 is significantly reduced relative to that shown in FIG. 7A. This is because the spectrum 428 of the dirty fire has a broad background and the long-wide filter 424 detects more energy than when the fire is clean. The ratio r2 reduces as the angle of incidence on the detector increases. At large angles of incidence, the ratio r2 approaches the ratio r4, i.e. the signal to noise ratio becomes very small. Thus, if the narrow and long-wide filters were to be used alone, the determination of the presence of a fire would be more difficult for larger angles of incidence.

In contrast, the ratio r1 increases to a maximum value as the angle of incidence increases from normal. An important feature demonstrated by the above analysis is that the ratio r1 always stays significantly above the ratio r3 over the range of incident angles examined. Thus, the results from the narrow and short-wide filters provide an increased ability to distinguish the presence of a large, dirty fire at a large angle of incidence on the detector.

This effect becomes increasingly important when the black body background arises from a hot radiator, such as the sun. FIG. 7C illustrates results where the black body background is assumed to be bright sunlight, i.e. at a temperature of 5800 K. In this case, the ratio r2 falls to a level equal to r4 at high angle of incidence, producing a signal to noise ratio of 1. However, the ratio r1 stays significantly above the ratio r3, particularly at large angles of incidence. This effect may be used by the detector to determine the presence of a fire even at large angles of incidence and under conditions of hot, bright background radiation and where the fire is dirty and produces a broad emission spectrum.

Figure 8:
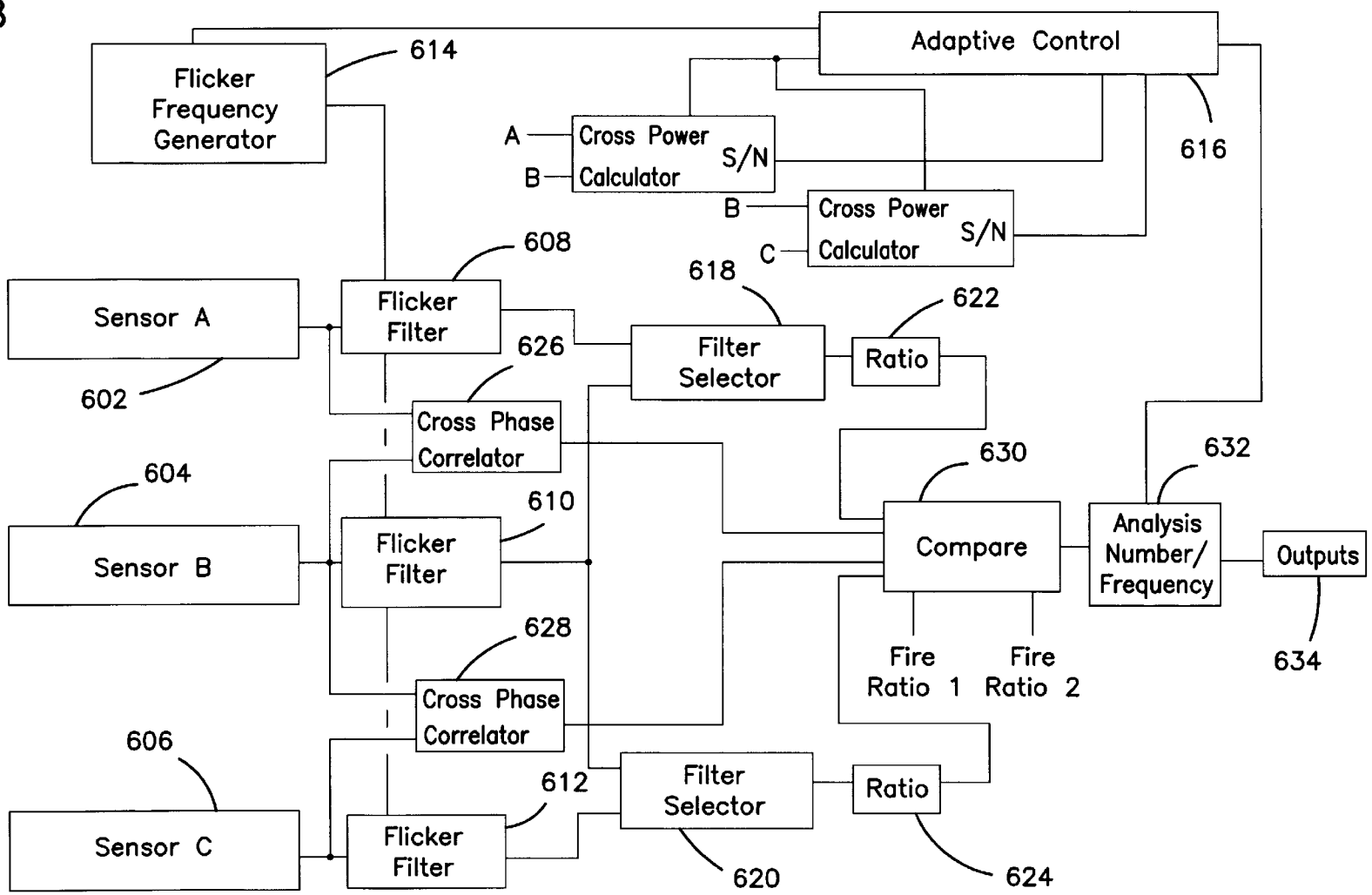
FIG. 8 illustrates a block diagram schematic of an optical fire detection apparatus.

The above discussion has been directed at the choice of radiation bands selected for generating signals from different sensors in the fire detector. These selected radiation bands may be used with different types of signal analysis for producing a detected fire alarm. For example, the simple circuit illustrated in FIG. 1 may be used. It will be appreciated that other methods of signal analysis may also be applied. One such method is disclosed in U.S. Pat. No. 5,850,182, filed on Jan. 7, 1997 by an inventor common with the present application, having an assignment common to the present application, which is incorporated herein by reference. The techniques of the U.S. Pat. No. 5,850,182 are included in an embodiment of a fire detector illustrated in FIG. 8. This embodiment employs sensors operating at three wavelength ranges. Sensor A 602 corresponds to the long-wide filter, sensor B 604 corresponds to the narrow filter, and sensor C 606 corresponds to the short-wide filter. The outputs from the sensors 602, 604 and 606 may be analyzed in a number of ways in order to produce a reliable indication that a fire is present.

First, the signals are passed through respective flicker filters 608, 610 and 612 to determine the frequency components that are present in the amplitudes detected. Typically a flame contains flicker components in the range 1 to 10 Hz. The flicker filters 608, 610 and 612 select out a frequency component within that range. The flicker filters 608, 610 and 612 are controlled by the flicker frequency generator 616.

The outputs from each flicker filter 608, 610 and 612 are directed through respective filter selectors 618 and 620 which produce a ratio output 622 and 624 respectively. The ratio produced by the ratio circuit 622 is the ratio of the signal of sensor B divided by the ratio of the signal of sensor A minus the signal of sensor B, all at the selected frequency component. Likewise, the ratio generated by the ratio circuit 624 is the ratio of the signal produced by the sensor B divided by the signal produced by sensor C minus the signal produced by sensor B, all at the selected frequency component.

Thus, by analyzing the output from each sensor 602, 604 and 606 over a range of flicker frequency components, the detector can distinguish over an unmodulated black body source, or one having regular modulation, for example a light source behind a rotating fan at a modulation frequency of 5 Hz.

Additionally, cross-phase correlation is performed between signals A and B and signals B and C to further distinguish over background effects. Therefore, the cross-phase correlator 626 produces a correlation between signals from sensor A 602 and sensor B 604. The cross-phase correlator 628 produces a correlation signal from the signals produced by sensor B 604 and sensor C 606.

The ratios from the ratio circuits 622 and 624, and the correlation signals from the correlators 626 and 628 are compared in the compare unit 630 against predetermined fire ratios 1 and 2. The output from the compare unit is analyzed in the analysis number frequency unit 632 and, if the detector concludes that a fire is present, an alarm signal is transmitted to the output 634.

As noted above, the present invention is applicable to the optical detection of fires. It is believed to be particularly useful in detecting fires in an environment including a number of false fire sources, including detection of small and large fires under different conditions of background radiation. It is also believed to be useful in extending the field of view over which the detector produces a reliable fire alarm signal. Accordingly, the present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

We claim:

1. A method of monitoring an area for the presence of a fire, comprising:

sensing radiation within a first spectral band, and within a second spectral band broader than, and overlapping, the first spectral band, each of the spectral bands having long and short cut-off wavelengths, a separation between one of the long cut-off wavelengths of the first and second spectral bands and the short cut-off wavelengths of the first and second spectral bands being less than approximately 50% of a bandwidth of the first spectral band and greater than 0% of the bandwidth of the first spectral band; and determining from the sensed radiation whether a fire is present in the monitored area.

2. A method as recited in claim 1, wherein the separation is less than approximately 15% of the bandwidth of the first spectral band.

3. A method as recited in claim 2, wherein the separation is less than approximately 5% of the bandwidth of the first spectral band.

4. A method as recited in claim 1, wherein the second spectral band has a bandwidth of approximately three times a bandwidth of the first spectral band.

5. A method as recited in claim 1, wherein the first spectral band encompasses at least a portion of a $CO_2$ emission peak at approximately 4.5 $\mu$m and has a bandwidth of less than 0.2 $\mu$m.

6. A method as recited in claim 1, further comprising sensing radiation within a third spectral band broader than, and overlapping, the first spectral band, a short cut-off wavelength of the third spectral band being substantially similar to the short cut-off wavelength of the first spectral band where the first and second spectral bands have substantially similar long cut-off wavelengths, and a long cut-off wavelength of the third spectral band being substantially similar to the long cut-off wavelength of the first spectral band where the first and second spectral bands have substantially similar short cut-off wavelengths.

7. A method as recited in claim 1, further comprising sensing radiation within a third spectral band whose center wavelength is longer than a center wavelength of the first spectral band where the center wavelength of the first spectral band is longer than a center wavelength of the second spectral band, and whose center wavelength is shorter than the center wavelength of the first spectral band where the center wavelength of the first spectral band is shorter than the a center wavelength of the second spectral band.

8. A method as recited in claim 7, wherein the third spectral band does not overlap the first or second spectral bands.

9. A method as recited in claim 1, wherein determining whether a fire is present comprises extracting flicker frequency components for the radiation sensed in the first and second spectral bands.

10. A method as recited in claim 1, wherein determining whether a fire is present comprises analyzing relative amounts of radiation sensed in the first and second spectral bands.

11. A method as recited in claim 1, wherein incident angular dependencies of the first and second short cut-off wavelengths are substantially similar.

12. Apparatus for detecting a fire in a monitored area, comprising:

first and second sensors sensitive to radiation in first and second spectral bands respectively, the second spectral band being wider than, and overlapping, each of the spectral bands having long and short cut-off wavelengths, one of the long cut-off wavelengths of the first and second spectral bands and the short cut-off wavelengths of the first and second spectral bands being substantially similar, a separation between the one of the long cut-off wavelengths of the first and second spectral bands and the short cut-off wavelengths of the first and second spectral bands is less than approximately 50% of a bandwidth of the first spectral band and greater than 0% of the bandwidth of the first spectral band; and a processing unit configured to determine the presence of a fire in the monitored area based on signals received from the first and second sensors.

13. An apparatus as recited in claim 12, wherein the separation is less than approximately 15% of the bandwidth of the first spectral band.

14. An apparatus as recited in claim 13, wherein the separation is less than approximately 5% of the bandwidth of the first spectral band.

15. An apparatus as recited in claim 12, wherein the processing unit processes a signal associated with a ratio of the signals received from the first and second sensors.

16. An apparatus as recited in claim 12, wherein the processing unit correlates the signals received from the first and second sensors.

17. An apparatus as recited in claim 12, wherein the processing unit analyzes temporal dependence of amplitude variation of the radiation in the first and second spectral bands.

18. An apparatus as recited in claim 12, wherein the first spectral band encompasses at least a portion of a $CO_2$ emission peak at approximately 4.5 $\mu$m and has a bandwidth of less than 0.2 $\mu$m.

19. An apparatus as recited in claim 12, further comprising a third sensor sensitive to radiation within a third spectral band whose center wavelength is longer than a center wavelength of the first spectral band where the center wavelength of the first spectral band is longer than a center wavelength of the second spectral band, and whose center wavelength is shorter than the center wavelength of the first spectral band where the center wavelength of the first spectral band is shorter than the a center wavelength of the second spectral band.

20. An apparatus as recited in claim 12, further comprising a third sensor sensitive to radiation in a third spectral band broader than, and overlapping, the first spectral band, a short cut-off wavelength of the third spectral band being substantially similar to the short cut-off wavelength of the first spectral band where the first and second spectral bands have substantially similar long cut-off wavelengths, and a long cut-off wavelength of the third spectral band being substantially similar to the long cut-off wavelength of the first spectral band where the first and second spectral bands have substantially similar short cut-off wavelengths.

21. A method of monitoring for the presence of a fire, comprising:

monitoring radiation at a plurality of overlapping spectral bands, where one of short cut-off wavelengths of each of the spectral bands and long cut-off wavelengths of each of the spectral bands vary with angle of incidence on a corresponding sensor in an essentially similar manner; and determining the presence of the fire based on relative amounts of radiation in the spectral bands.

22. A method as recited in claim 21, wherein the cut-off wavelengths of one of the plurality of spectral bands have an angle-dependence within 25% of the angle dependence of the cut-off wavelengths of another of the plurality of spectral bands.

23. A method as recited in claim 22, wherein cut-off wavelengths of the one and the other of the plurality of spectral bands have angle-dependencies within 15%.

24. A method as recited in claim 21, wherein one of the plurality of spectral bands is centered at approximately 4.45 $\mu$m and has a bandwidth of less than approximately 0.2 $\mu$m.

25. A method as recited in claim 21, wherein the one of the short cut-off wavelengths and the long cut-off wavelengths of two of the plurality of spectral bands are essentially similar.

26. A method as recited in claim 25, wherein the one of the short cut-off wavelengths and the long cut-off wavelengths of the two of the plurality of spectral bands are separated by less than approximately 50% of a bandwidth of a narrower of the two of the plurality of spectral bands.

27. A method as recited in claim 21, further comprising a spectral band which is non-overlapping with the plurality of overlapping spectral bands.

28. A method as recited in claim 27, wherein determining the presence of the fire comprises comparing relative amounts of radiation monitored in the overlapping and non-overlapping spectral bands.

29. A method as recited in claim 21, wherein determining the presence of the fire comprises extracting flicker frequency components from the radiation monitored in the spectral bands.

30. A method as recited in claim 21, wherein determining whether a fire is present comprises analyzing relative amounts of radiation sensed in first and second spectral bands.

31. Apparatus for detecting fire in a monitored area, comprising:

a plurality of sensors sensitive to radiation in corresponding overlapping spectral bands, one of short cut-off wavelengths for each of the spectral bands and long cut-off wavelengths for each of the spectral bands having essentially similar variations with angle of incidence on the corresponding sensor; and a processing unit coupled to the sensors and configured to determine the presence of a fire based on signals received from the plurality of sensors.

32. An apparatus as recited in claim 31, wherein the cut-off wavelengths of one of the plurality of spectral bands have an angle-dependence within 25% of the angle-dependence of the cut-off wavelengths of another of the plurality of spectral bands.

33. An apparatus as recited in claim 32, wherein the angle-dependencies of the cut-off wavelengths of the one and the other of the plurality of spectral bands are within 15%.

34. An apparatus as recited in claim 31, wherein the processing unit processes a signal associated with a ratio of the signals received from the plurality of sensors.

35. An apparatus as recited in claim 31, wherein the processing unit correlates the signals received from the plurality of sensors.

36. An apparatus as recited in claim 31, wherein the processing unit analyzes temporal dependence of amplitude variation of the radiation in the spectral bands.

37. An apparatus as recited in claim 31, wherein one of the spectral bands is centered at approximately 4.5 $\mu$m and has a bandwidth of less than 0.2 $\mu$m.

38. An apparatus as recited in claim 31, further comprising a further sensor sensitive to radiation in a spectral band non-overlapping with the plurality of overlapping spectral bands.

39. An apparatus as recited in claim 31, wherein the one of the short cut-off wavelengths and the long cut-off wavelengths of the spectral bands are essentially similar for two of the spectral bands.

40. An apparatus as recited in claim 39, wherein the one of the short cut-off wavelengths and the long cut-off wavelengths of the two of the plurality of spectral bands are separated by less than approximately 50% of a bandwidth of a narrower of the two of the plurality of spectral bands.

41. An apparatus as recited in claim 38, wherein the non-overlapping spectral band is centered at a wavelength less than the overlapping spectral bands.

42. A method of detecting radiation in an area where there is a risk of fire, comprising monitoring radiation at a plurality of overlapping spectral bands, each spectral band having a short and a long cut-off wavelength, one of short and long cut-off wavelength of at least two of the spectral bands varying with angle of incidence on a sensor used to monitor the spectral bands in a substantially similar manner.

43. A method of detecting radiation in an area where there is a risk of fire, comprising:

monitoring radiation in at least three spectral bands, each of the spectral bands having a short and a long cut-off wavelength, short cut-off wavelengths of first and second spectral bands being essentially similar and long cut-off wavelengths of first and third spectral bands being essentially similar, the first spectral band being narrower than the second and third spectral bands.

44. A method of monitoring an area for the presence of a fire, comprising:

sensing radiation within first, second and third spectral bands, the second spectral band broader than, and overlapping, the first spectral band, a long cut-off wavelength of the first spectral band and a long wavelength cut-off of the second spectral band being substantially similar, the third spectral band being broader than, and overlapping, the first spectral band, a short cut-off wavelength of the first spectral band being substantially similar to a short wavelength cut-off wavelength of the third spectral band; and determining from the sensed radiation whether a fire is present in the monitored area.

45. A method as recited in claim 44, wherein a separation between one of a) the long cut-off wavelengths of the first and second spectral bands and b) the short cut-off wavelengths of the first and third spectral bands is less than approximately 50% of a bandwidth of the first spectral band.

46. A method as recited in claim 45, wherein a separation between the other of i) the long cut-off wavelengths of the first and second spectral bands and ii) the short cut-off wavelengths of the first and third spectral bands is less than approximately 50% of a bandwidth of the first spectral band.

47. A method as recited in claim 44, wherein the first spectral band encompasses at least a portion of a $CO_2$ emission peak at approximately 4.5 $\mu$m and has a bandwidth of less than 0.2 $\mu$m.

48. A method as recited in claim 44, wherein the first spectral band has a center wavelength between center wavelengths of the second and third spectral bands.

49. A method as recited in claim 44, wherein determining whether a fire is present comprises extracting flicker frequency components for the radiation sensed in the first and second spectral bands.

50. A method as recited in claim 44, wherein incident angular dependencies of the first and second short cut-off wavelengths are substantially similar.

51. A method of monitoring an area for the presence of a fire, comprising:

sensing radiation within first, second and third spectral bands, the second spectral band being broader than, and overlapping, the first spectral band, each of the spectral bands having long and short cut-off wavelengths, one of i) the long cut-off wavelengths of the first and second spectral bands and ii) the short cut-off wavelengths of the first and second spectral bands being substantially similar, the first spectral band having a center wavelength between center wavelengths of the second and third spectral bands; and determining from the sensed radiation whether a fire is present in the monitored area.

52. A method as recited in claim 51, wherein a separation between the one of i) the long cut-off wavelengths of the first and second spectral bands and ii) the short cut-off wavelengths of the first and second spectral bands is less than approximately 50% of a bandwidth of the first spectral band.

53. A method as recited in claim 51, wherein the first spectral band encompasses at least a portion of a $CO_2$ emission peak at approximately 4.5 $\mu$m and has a bandwidth of less than 0.2 $\mu$m.

54. A method as recited in claim 51, wherein a long cut-off wavelength of the first spectral band and a long wavelength cut-off of thc second spectral band are substantially similar, the third spectral band is broader than, and overlaps, the first spectral band, and a short cut-off wavelength of the first spectral band is substantially similar to a short wavelength cut-off wavelength of the third spectral band.

55. A method as recited in claim 51, wherein the third spectral band lies outside both the first and second spectral bands.

56. A method as recited in claim 51, wherein determining whether a fire is present comprises extracting flicker frequency components for the radiation sensed in the first and second spectral bands.

57. A method as recited in claim 51, wherein incident angular dependencies of the first and second short cut-off wavelengths are substantially similar.

58. Apparatus for detecting a fire in a monitored area, comprising:

first, second and third sensors sensitive to radiation in first, second and third spectral bands respectively, the second spectral band being wider than the first spectral band, each of the spectral bands having long and short cut-off wavelengths, the long cut-off wavelengths of the first and second spectral bands being substantially similar and the short cut-off wavelengths of the first and third spectral bands being substantially similar; and a processing unit coupled to receive signals from the first, second and third sensors, and to determine the presence of a fire in the monitored area based on the received signals.

59. An apparatus as recited in claim 58, wherein a separation between one of a) the long cut-off wavelengths of the first and second spectral bands and b) the short cut-off wavelengths of the first and third spectral bands is less than approximately 50% of a bandwidth of the first spectral band.

60. An apparatus as recited in claim 58, wherein the processing unit correlates the signals received from at least two of the sensors.

61. An apparatus as recited in claim 58, wherein the processing unit analyzes temporal dependence of amplitude variation of the radiation in at least two of the spectral bands.

62. An apparatus as recited in claim 58, wherein the first spectral band encompasses at least a portion of a $CO_2$ emission peak at approximately 4.5 $\mu$m and has a bandwidth of less than 0.2 $\mu$m.

63. An apparatus as recited in claim 58, wherein the first spectral band has a center wavelength between central wavelengths of the second and third spectral bands.

64. Apparatus for detecting a fire in a monitored area, comprising:

first, second and third sensors sensitive to radiation in first, second and third spectral bands respectively, the second spectral band being wider than, and overlapping the first spectral band, the first spectral band having a center wavelength between center wavelengths of the second and third spectral bands; and a processing unit configured to determine the presence of a fire in the monitored area based on signals received from the first and second sensors.

65. An apparatus as recited in claim 64, each of the spectral bands having long and short cut-off wavelengths, the long cut-off wavelengths of the first and second spectral bands being substantially similar and the short cut-off wavelengths of the first and third spectral bands being substantially similar.

66. An apparatus as recited in claim 65, wherein a separation between one of a) the long cut-off wavelengths of the first and second spectral bands and b) the short cut-off wavelengths of the first and third spectral bands is less than approximately 50% of a bandwidth of the first spectral band.

67. An apparatus as recited in claim 64, wherein the processing unit correlates the signals received from at least two of the sensors.

68. An apparatus as recited in claim 64, wherein the processing unit analyzes temporal dependence of amplitude variation of the radiation in at least two of the spectral bands.

69. An apparatus as recited in claim 64, wherein the first spectral band encompasses at least a portion of a $CO_2$ emission peak at approximately 4.5 $\mu$m and has a bandwidth of less than 0.2 $\mu$m.

* * * * *